US006236318B1

(12) United States Patent
Yang et al.

(10) Patent No.: US 6,236,318 B1
(45) Date of Patent: May 22, 2001

(54) SYSTEMS FOR IDENTIFICATION AND ESTRUS STATE DETECTING IN CATTLE

(75) Inventors: Boh-Suk Yang, Suwon; Sung-Jae Park, Kyunggi-Do; Gi-Sun Im; Sung-Jong Oh, both of Suwon; Hyun-Suck Yang, Kyunggi-Do; Sung-Joon Lee, Seoul, all of (KR)

(73) Assignee: Republic of Korea (Management:Rural Development Admnistration), Kyunggi-Do (KR)

( * ) Notice: Subject to any disclaimer, the term of this patent is extended or adjusted under 35 U.S.C. 154(b) by 0 days.

(21) Appl. No.: 09/474,713

(22) Filed: Dec. 29, 1999

(51) Int. Cl.[7] ..... G08B 23/00

(52) U.S. Cl. ..... 340/573.3; 340/523.1; 340/539; 340/10.41; 119/1; 119/174; 600/551; 600/549; 600/588

(58) Field of Search ..... 340/573.3, 573.1, 340/539, 10.41; 600/551, 549, 588; 119/1, 174

(56) References Cited

U.S. PATENT DOCUMENTS

| | | | | |
|---|---|---|---|---|
| 4,618,861 | * | 10/1986 | Gettens et al. | 340/10.41 |
| 4,635,587 | * | 1/1987 | Leonardo | 119/1 |
| 4,854,328 | * | 8/1989 | Pollack | 600/540 |
| 4,895,165 | * | 1/1990 | Blair | 600/551 |
| 4,936,316 | * | 6/1990 | Jewett | 600/588 |
| 5,111,799 | * | 5/1992 | Senger et al. | 600/551 |
| 5,511,560 | * | 4/1996 | Begouen | 600/588 |
| 5,542,431 | * | 8/1996 | Starzl et al. | 600/551 |
| 5,566,679 | * | 10/1996 | Herriott | 600/551 |
| 5,786,758 | * | 7/1998 | Bullock | 340/539 |
| 5,796,334 | * | 8/1998 | Chen et al. | 340/539 |
| 5,881,673 | * | 3/1999 | Beach et al. | 119/174 |
| 6,049,280 | * | 4/2000 | Andersson | 340/573.3 |

* cited by examiner

*Primary Examiner*—Benjamin C. Lee
(74) *Attorney, Agent, or Firm*—Nawrocki, Rooney & Silvertson, P.A.

(57) ABSTRACT

In a system for identifying a plurality of cattle bred on a livestock farm and detecting an estrus state thereof, an apparatus for detecting and identifying any one of cows in the estrus state, comprising a switch mounted on a caudal part of a corresponding one of the cows in such a manner that it can be operated when a different one of the cows mounts the corresponding cow, an encoder for generating an inherent identification code with respect to the corresponding cow in response to the operation of the switch, a radio transmitter/receiver circuit for transmitting the inherent identification code from the encoder externally by radio and receiving an external identification code by radio, a decoder for decoding the external identification code received by the radio transmitter/receiver circuit to detect an identification code value therefrom, a comparator for comparing the identification code value from the decoder with a prestored identification code value of the corresponding cow to determine whether the two identification code values are the same, and an indicator responsive to an output signal from the comparator for indicating that the identification code value from the decoder is the same as the prestored identification code value.

19 Claims, 3 Drawing Sheets

SYSTEMS FOR IDENTIFICATION AND ESTRUS STATE DETECTING IN CATTLE

BACKGROUND OF THE INVENTION

1. Field of the Invention

The present invention relates in general to systems for identification and estrus state detecting in cattle, and more particularly to an apparatus which is capable of detecting a cow in heat, transmitting the detected state by radio and providing an aural or visual indication of the detected state to the user so that he can identify the cow in heat.

2. Description of the Prior Art

Recently, livestock farmers have bred an increased number of cattle because they have accelerated the fecundity of the cattle while being specialized in stockbreeding. Generally, the livestock farmers have branded ranch's inherent identification (ID) numbers respectively on the hides of rumps of the cattle using a piece of heated iron or liquid nitrogen and identified the cattle according to the branded ranch's inherent ID numbers. However, such a method gives the cattle pain in the number branding procedure, resulting in a degradation in cattle welfare.

A different conventional cattle identification method is to attach rubber boards marked with individual ID numbers, respectively, to ears of cattle. It is easy to attach the rubber boards, however this method has a disadvantage in that they are liable to become soiled and the numbers in the boards thereof are liable to be erased, thereby making it very hard to accurately identify the cattle.

On the other hand, one conventional estrus state detection method is to observe an estrus state of cattle directly with the naked eye. In this method, the observation must be made at least twice a day with respect to the estrus state of the cattle to obtain an estrus observation ratio of 90% or more. However, this method is disadvantageous in that it is difficult to observe cattle with a short estrus duration.

Another conventional estrus state detection method is to detect an estrus state of a cow according to estrus-based mount permission of the cow. A tube filled with ink is mounted on a caudal part of the cow, and it is then burst to discharge the ink upon mount permission. As a result, the estrus state of the cow is detected with the ink discharged. However, this method has high dection accruacy, but it is unable to recognize an exact estrus start time.

Yet another conventional estrus state detection method is that a switch is mounted on a caudal part of a cow for the recording of an estrus state of the cow upon mount permission. However, in this method, ID codes are not assigned to cows proper identification methods are not provided , thereby making it hard to identify a certain one of the cows in heat.

Further, there is required a technique capable of performing both the above cattle identification and estrus state detection to reduce the amounts of time and labor power is required.

SUMMARY OF THE INVENTION

Therefore, the present invention has been made in view of the above problems, and it is an object of the present invention to provide an apparatus which is capable of detecting and identifying a cow in heat easily and rapidly.

In accordance with the present invention, the above and other objects can be accomplished by a provision of, in a system for identifying a plurality of cattle bred on a livestock farm and detecting an estrus state thereof, an apparatus for detecting and identifying any one of cows in the estrus state, comprising switch means mounted on a caudal part of a corresponding one of the cows in such a manner that it can be operated when a different one of the cows mounts the corresponding cow; an encoder for generating an inherent identification code with respect to the corresponding cow in response to the operation of the switch means; a radio transmitter/receiver circuit for transmitting the inherent identification code from the encoder externally by radio and receiving an external identification code by radio; a decoder for decoding the external identification code received by the radio transmitter/receiver circuit to detect an identification code value therefrom; a comparator for comparing the identification code value from the decoder with a prestored identification code value of the corresponding cow to determine whether the two identification code values are coincide ; and indication means responsive to an output signal from the comparator for indicating that the identification code value from the decoder is the same as the prestored identification code value.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

In the following description made in conjunction with the preferred embodiments of the present invention, a variety of specific elements such as constituting elements of concrete circuits are shown. The description of such elements has been made only for a better understanding of the present invention. Those skilled in the art will appreciate that the present invention can be implemented without using the above-mentioned specific elements. In the following description of the present invention, a detailed description of known functions and configurations incorporated herein will be omitted when it may make the subject matter of the present invention rather unclear.

Figure 1:
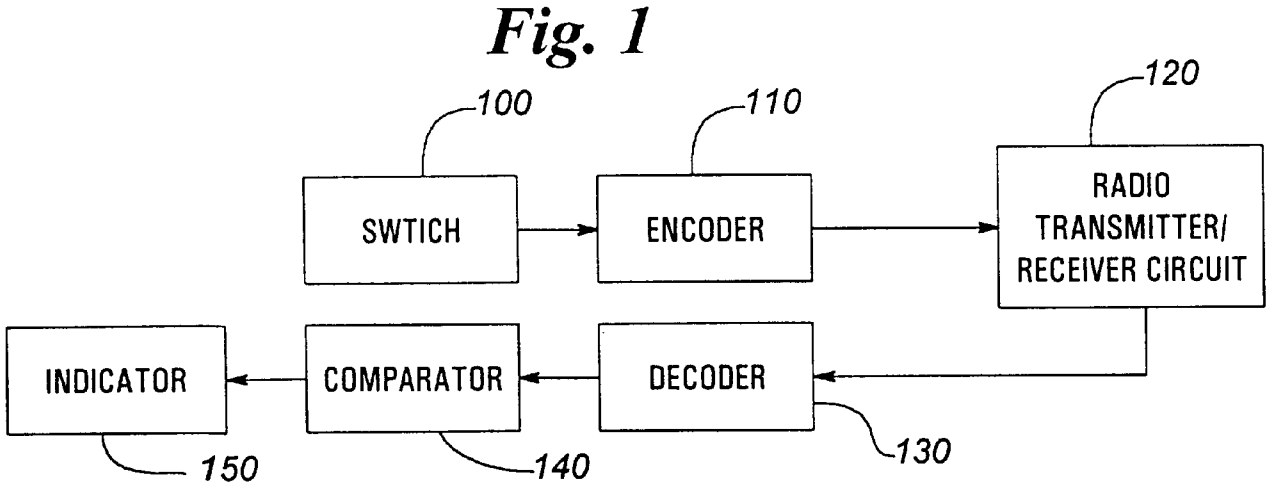
FIG. 1 is a block diagram of an apparatus for detecting and identifying any one of cows in an estrus state in accordance with the present invention.

With reference to FIG. 1, there is shown in block form the construction of an apparatus for detecting and identifying any one of cows in an estrus state in accordance with the present invention. As shown in this drawing, a switch 100 is mounted on a caudal part of a corresponding one of the cows in such a manner that it can be operated when a different one of the cows mounts the corresponding cow. Preferably, the switch 100 may be a pushbutton switch.

An encoder 110 is provided to generate an inherent ID code with respect to the corresponding cow in response to the operation of the switch 100.

A radio transmitter/receiver circuit 120 is adapted to transmit the inherent ID code from the encoder 110 externally by radio. The radio transmitter/receiver circuit 120 also receives an external ID code by radio.

A decoder 130 functions to decode the external ID code received by the radio transmitter/receiver circuit 120 to detect an ID code value therefrom.

A comparator 140 functions to compare the ID code value from the decoder 130 with a prestored ID code value of the corresponding cow to determine whether the two ID code values are the same.

An indicator 150 is operated in response to an output signal from the comparator 140 to indicate that the ID code value from the decoder 130 is the same as the prestored ID code value. Preferably, the indicator 150 may be a buzzer for providing an aural indication to the user. Alternatively, the indicator 150 may be a lamp for providing a visual indication to the user.

Figure 2:
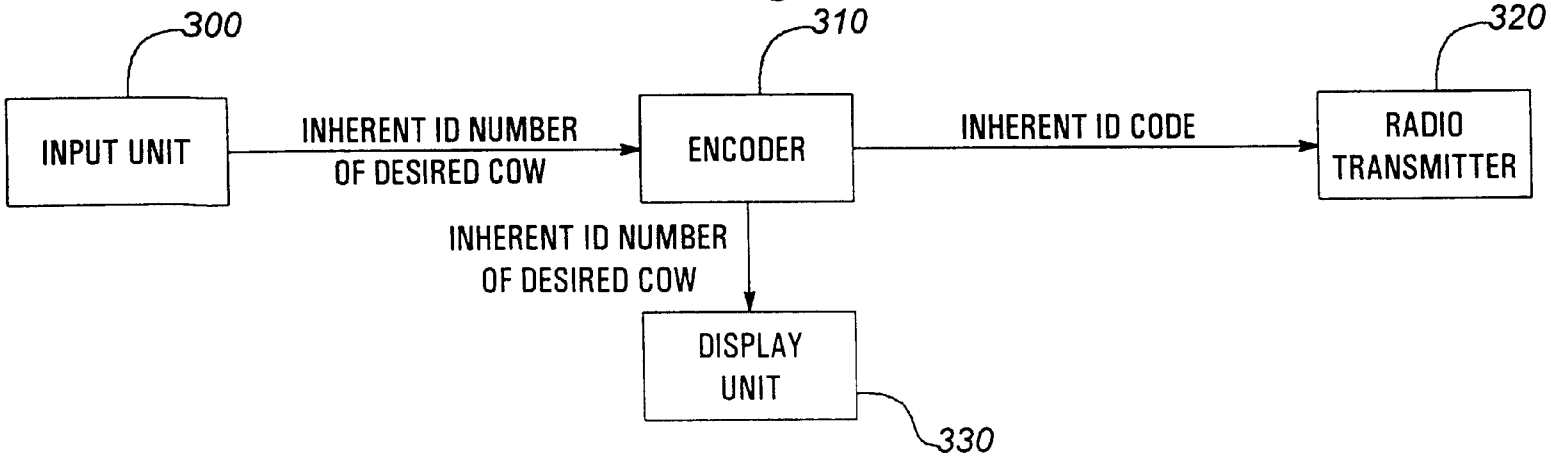
FIG. 2 is a block diagram of an apparatus for identifying cows in accordance with the present invention.

With reference to FIG. 2, there is shown in block form the construction of an apparatus for identifying cows in accordance with the present invention. As shown in this drawing, an input unit 300 is provided to input an inherent ID number or name of a desired one of the cows. Preferably, the input unit 300 may be a keypad.

An encoder 310 is adapted to encode the inherent ID number or name inputted by the input unit 300 to generate an inherent ID code with respect to the desired cow.

A display unit 330 functions to receive the inherent ID number or name inputted by the input unit 300 through the encoder 310 and display it to be visually confirmed by the user.

A radio transmitter 320 is provided to transmit the inherent ID code from the encoder 310 externally by radio.

Figure 3:
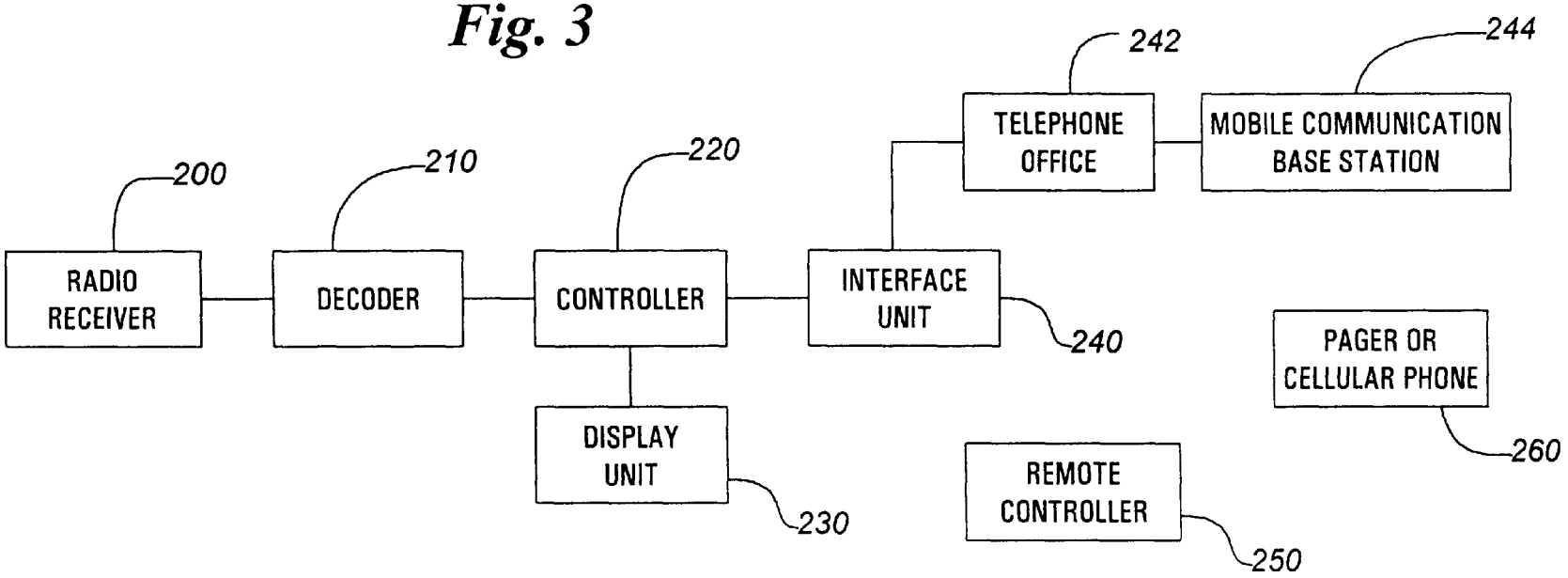
FIG. 3 is a block diagram of an apparatus for detecting any one of cows in an estrus state in accordance with the present invention.

With reference to FIG. 3, there is shown in block form the construction of an apparatus for detecting any one of cows in an estrus state in accordance with the present invention. As shown in this drawing, a radio receiver 200 is provided to receive an inherent ID code of the cow in the estrus state by radio.

A decoder 210 is adapted to decode the inherent ID code received by the radio receiver 200 to detect an ID code value therefrom.

A controller 220 calculates, on the basis of the ID code value from the decoder 210, an estrus time indicative of when the inherent ID code of the cow in the estrus state is received and the number of estrus times indicative of the number of times that the inherent ID code of the cow in the estrus state is received. Then, the controller 220 records the calculated results and also converts them into signals recognizable by a display unit 230.

The display unit 230 is operated under control of the controller 220 to display the ID code value, the estrus time and the number of estrus times.

An interface unit 240 is provided to externally transmit information from the controller 220 regarding the ID code value, the estrus time and the number of estrus times. Preferably, the interface unit 240 may include a wire transmitter for transmitting the information from the controller 220 to a telephone office 242 by wire so that the user can confirm the transmitted information through a pager or cellular phone 260. In this case, the telephone office 242 is connected to the pager or cellular phone 260 via a mobile communication base station 244. Alternatively, the interface unit 240 may include a radio transmitter for transmitting the information from the controller 220 to a remote computer 250 by radio so that the user can confirm the transmitted information through the remote computer 250.

The operation of the present invention with the above-mentioned construction will hereinafter be described in detail with reference to FIG. 4.

Figure 4:
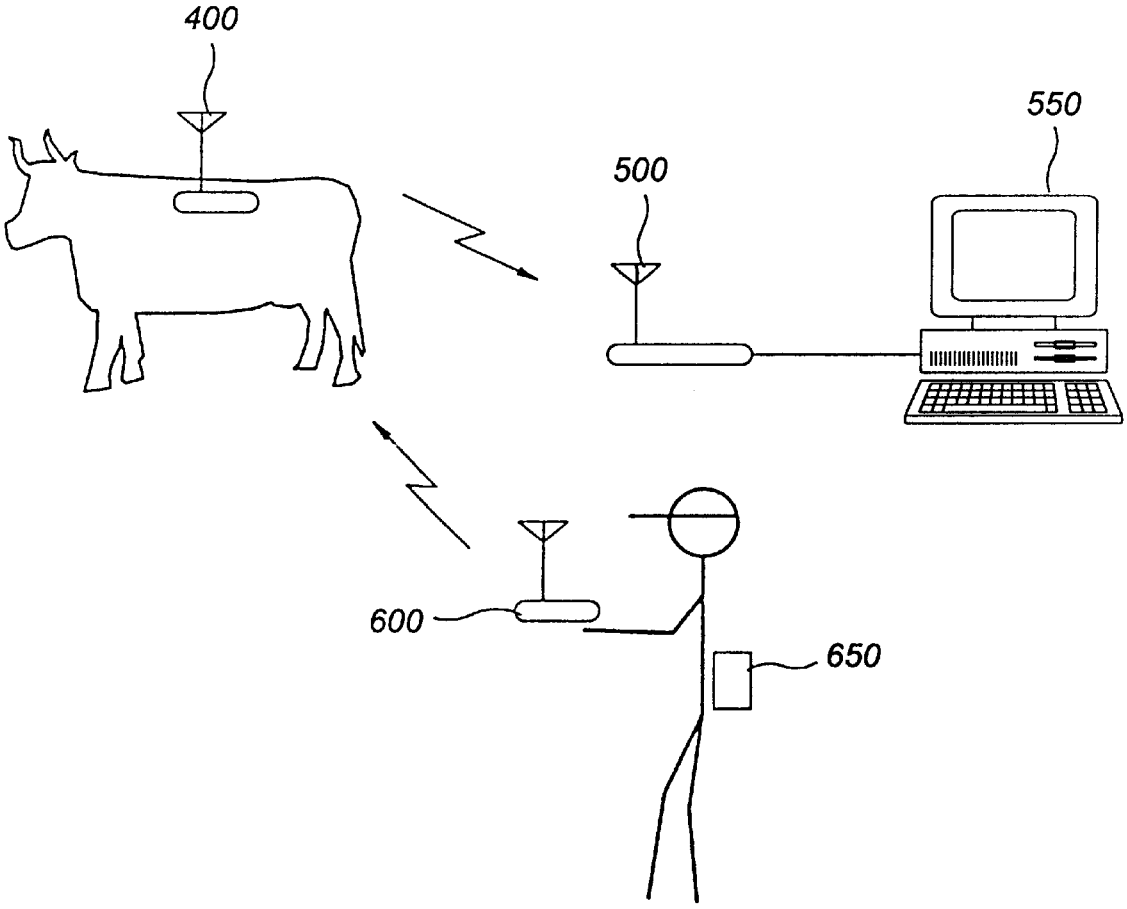
FIG. 4 is a view illustrating the entire system in accordance with the present invention.

FIG. 4 is a view illustrating the entire system in accordance with the present invention. In this drawing, the reference numeral 400 denotes the detection/identification apparatus of FIG. 1, 500 denotes the radio receiver in the detection apparatus of FIG. 3, 550 denotes the detection apparatus of FIG. 3, 600 denotes the identification apparatus of FIG. 2 and 650 denotes the user's pager or cellular phone.

Generally, if a c ertain cow co mes into heat, then a different cow will mount it. At this t ime, in the detection/identification apparatus 400 mounted on the certain cow, the switch is operated, thereby causing the encoder to generate an inherent ID code of the certain cow and transmit the generated inherent ID code externa lly through the radio transmitter/receiver circuit.

Then, in the detection apparatus 550, the inherent ID code of the certain cow, transmitted from the detection/identification apparatus 400, is received by the radio receiver 500 and applied to the decoder, which then detects an ID code value therefrom. The controller calculates an estrus time and the number of estrus times on the basis of the ID code value from the decoder and displays the calculated results on the display unit together with the ID code value from the decoder. The controller also transfers information regarding the ID code value, the estrus time and the number of estrus times to the interface unit. Then, the interface unit transmits the information from the controller to the remote computer by radio or to the telephone office by wire. The telephone office, in turn, transmits the information transmitted from the interface unit to the mobile communication base station. As a result, the mobile communication base station sends the information regarding the estrus state of the certain cow to the user's pager or cellular phone 650.

Upon receiving the estrus state information through the pager or cellular phone 650, the user enters an inherent ID number of the certain cow through the input unit in the identification apparatus 600 to confirm that cow. Then in the identification apparatus 600, the encoder encodes the inherent ID number entered through the input unit to generate an inherent ID code with respect to the certain cow. The encoder also transfers the entered inherent ID number to the display unit to display it thereon. Then, the inherent ID code from the encoder is transmitted through the radio transmitter to the detection/identification apparatus 400 mounted on the certain cow.

Then in the detection/identification apparatus 400, the inherent ID code transmitted from the identification apparatus 600 is received by the radio transmitter/receiver circuit and applied to the decoder, which then detects an ID code value therefrom. The comparator compares the ID code value from the decoder with a prestored ID code value of the certain cow to determine whether the two ID code values are the same. If the ID code value from the decoder is the same as the prestored ID code value, the indicator provides an aural or visual indication to the user. As a result, the user can readily confirm that the certain cow is in heat.

As apparent from the above description, according to the present invention, there is little error in the estrus state detection on the livestock farm, and the cattle identification can readily be made by the livestock farmer. Therefore, the present invention has the effect of significantly reducing the amounts of time and labor power being required and managing the ranch readily.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a system for identifying a plurality of cattle bred on a livestock farm and detecting an estrus state thereof, a detection/identification apparatus for detecting and identifying any one of cows in the estrus state, comprising:

switch means mounted on a caudal part of a corresponding one of the cows in such a manner that it can be operated when a different one of the cows mounts the corresponding cow;

an encoder for generating an inherent identification code with respect to said corresponding cow in response to the operation of said switch means;

a radio transmitter/receiver circuit for transmitting said inherent identification code from said encoder externally by radio and receiving an external identification code by radio;

a decoder for decoding the external identification code received by said radio transmitter/receiver circuit to detect an identification code value therefrom;

a comparator for comparing said identification code value from said decoder with a prestored identification code value of said corresponding cow to determine whether the two identification code values are the same; and indication means responsive to an output signal from said comparator for indicating that said identification code value from said decoder is the same as said prestored identification code value.

2. The apparatus asset forth in claim 1, wherein said switch means is a pushbutton switch.

3. The apparatus as set forth in claim 1, wherein said indication means is a buzzer for providing an aural indication to the user.

4. The apparatus as set forth in claim 1, wherein said indication means is a lamp for providing a visual indication to the user.

5. The system according to claim 1, wherein said system further comprises a detection apparatus comprising:

means for inputting an inherent identification number or name of a desired one of the cows;

means for encoding the inherent identification number or name inputted, by said means for inputting, to generate an inherent identification code with respect to the desired cow;

means for receiving said inherent identification number or name and displaying it to be confirmed by a user; and means for transmitting said inherent identification code from said means for encoding.

6. The system according to claim 5, wherein said means for inputting is provided by a keypad.

7. The apparatus as set forth in claim 5, wherein said interface means includes a wire transmitter for transmitting said information from said controller to a telephone office by wire so that the user can confirm the transmitted information through a pager or cellular phone.

8. The apparatus as set forth in claim 5, wherein said interface means includes a radio transmitter for transmitting said information from said controller to a remote computer by radio so that the user can confirm the transmitted information through said remote computer.

9. The system according to claim 1, wherein said system further comprises a communication base station apparatus, comprising:

a receiver for receiving an inherent identification code of the cow in said estrus state;

a decoder for decoding the inherent identification code received by said receiver to detect and identification code value therefrom;

a controller for calculating a estrus time and the number of estrus times on the basis of said identification code value from said decoder, recording the calculated results and converting them into displayable signals;

a display unit for displaying said identification code value, said estrus time and number of estrus times; and interface means for externally transmitting information from said controller regarding said identification code value, said estrus time and said number of estrus times.

10. A system for detecting the estrus state of a cow and identifying the cow from other cattle, comprising:

a detection/identification apparatus constructed and arranged to be mounted on a particular cow comprising a means responsible to estrus state for generating an inherent identification code corresponding to the particular cow, a transmitter for transmitting said code to a detection apparatus, a means for receiving an external identification code, means for comparing the external identification code with the inherent identification code, and means for indicating that the external identification code and the inherent identification code are identical;

a detection apparatus comprising means for receiving said inherent identification code, means for calculating information from the inherent identification code, and a transmitter for transmitting the information to a communication base station; and a communication base station comprising means for receiving information from said detection apparatus, means for conveying the information to a user, an input unit for the entering of an external identification code by a user, and means for transmitting said external identification code to said detection/identification apparatus.

11. The system according to claim 10, wherein said means for generating said inherent identification code is triggered by the operation of a switch means mounted to the caudal part of the particular cow in such a manner that it can be operated when a different cow mounts the particular cow.

12. The system according to claim 10, wherein said means for generating an inherent identification code is provided by an encoder.

13. The system according to claim 10, wherein said transmitter and said means for receiving are provided by a combination transmitter/receiver circuit.

14. The system according to claim 10, wherein said means for comparing is provided by a decoder that identifies an identification value code within both, the external identification code and the inherent identification code and a comparator that compares the codes.

15. The system according to claim 10, wherein said input unit receives a number or name and said number or name an encoder encodes the name or number into said external identification code.

16. The system according to claim 10, detection apparatus further comprises a display for displaying said calculated information.

17. The system according to claim 10, communication base station apparatus further comprises a display for displaying said external identification code after it has been entered by a user.

18. The system according to claim 16, wherein said means for indicating that the identification number and the inherent code are identical is provided by an indication means responsive to an output signal from said comparator.

19. The system according to claim 10, wherein said information includes an identification value code, estrus time, and number estrus times.

* * * * *